US010434740B2

(12) United States Patent
Takeuchi

(10) Patent No.: US 10,434,740 B2
(45) Date of Patent: Oct. 8, 2019

(54) PRESSED CREASE-FORMING MEMBER

(71) Applicant: DIEPEX CO., LTD, Osaka (JP)

(72) Inventor: Takayuki Takeuchi, Osaka (JP)

(73) Assignee: DIEPEX CO., LTD., Osaka (JP)

( * ) Notice: Subject to any disclaimer, the term of this patent is extended or adjusted under 35 U.S.C. 154(b) by 114 days.

(21) Appl. No.: 15/312,025

(22) PCT Filed: May 25, 2015

(86) PCT No.: PCT/JP2015/064901
§ 371 (c)(1),
(2) Date: Nov. 17, 2016

(87) PCT Pub. No.: WO2016/027538
PCT Pub. Date: Feb. 25, 2016

(65) Prior Publication Data

US 2017/0080668 A1 Mar. 23, 2017

(30) Foreign Application Priority Data

Aug. 18, 2014 (JP) ..... 2014-166011
Apr. 6, 2015 (WO) ..... PCT/JP2015/060737

(51) Int. Cl.
*B31F 1/10* (2006.01)
*B31F 1/08* (2006.01)
(Continued)

(52) U.S. Cl.
CPC ..... *B31F 1/10* (2013.01); *B31B 50/252* (2017.08); *B31B 50/256* (2017.08); *B31F 1/08* (2013.01);
(Continued)

(58) Field of Classification Search
CPC .. B31F 1/0012; B31F 1/10; B31F 1/08; B31B 2201/257; B31B 2241/003;
(Continued)

(56) References Cited

U.S. PATENT DOCUMENTS 1,402,259 A * 1/1922 Bridgman ..... B31F 1/10 493/110
1,550,033 A * 8/1925 Lange ..... B31B 1/00 229/930
(Continued)

FOREIGN PATENT DOCUMENTS

CN 203110414 8/2013
DE 100 62 294 6/2002
(Continued)

OTHER PUBLICATIONS

Office Action dated Nov. 21, 2016 in corresponding Korean Application No. 10-2016-7029266, with partial English translation.
(Continued)

*Primary Examiner* — Robert F Long
*Assistant Examiner* — Eduardo R Ferrero
(74) *Attorney, Agent, or Firm* — Wenderoth, Lind & Ponack, L.L.P.

(57) ABSTRACT

A pressed crease-forming member includes a strip-shaped member having a crease-forming portion formed with three or a larger-than-three odd number of ribs extending in the longitudinal direction of the strip-shaped member with one of the ribs located at the widthwise center of the crease-forming portion and each half of the remaining even number of ribs arranged on either side of the center rib. At least the top of the center rib, namely, the rib located at the widthwise center of the crease-forming portion, is chamfered. Grooves are formed between the adjacent ribs. The ribs are arranged such that the tops of the ribs are formed, as a whole, into a convex shape. The bottom of each groove is recessed beyond the tops of the ribs on both sides of the groove.

4 Claims, 9 Drawing Sheets

(51) Int. Cl.
*B31B 50/25* (2017.01)
*B26D 3/08* (2006.01)
*B31B 100/00* (2017.01)

(52) U.S. Cl.
CPC ..... *B26D 3/08* (2013.01); *B26D 3/085* (2013.01); *B31B 2100/002* (2017.08)

(58) Field of Classification Search
CPC ..... B31B 2219/25; B31B 2219/22; B31B 2219/257; B31B 2219/252; B31B 45/00; B31B 1/00; B31B 50/25; B31B 50/256; B31B 50/252; B65H 45/30; B65D 5/4266; B65D 3/08; B65D 3/085
USPC ..... 493/396, 397, 399, 402, 403; 83/884
See application file for complete search history.

(56) References Cited

U.S. PATENT DOCUMENTS 1,746,284 A * 2/1930 Robinson ..... B31F 1/10 493/354
1,798,475 A * 3/1931 Lange ..... B31B 1/00 493/403
1,977,812 A * 10/1934 Swift, Jr. ..... B31F 1/10 101/184
2,075,287 A * 3/1937 Jagusch ..... B31F 1/10 493/370
2,664,035 A * 12/1953 Roselius ..... B31F 1/10 493/287
2,906,529 A * 9/1959 McWhorter ..... B65H 3/24 101/279
2,949,827 A * 8/1960 Kempen ..... B31B 1/00 493/403
3,105,420 A * 10/1963 Phillips ..... B26F 1/44 493/354
3,526,566 A * 9/1970 McIlvain, Jr. ..... B31F 1/08 229/930
3,977,310 A * 8/1976 Keck ..... B31F 1/10 493/204
4,195,556 A * 4/1980 Gallagher ..... B31F 1/10 493/403
4,406,648 A * 9/1983 Cavagna ..... B31F 1/10 493/161
4,596,541 A * 6/1986 Ward, Sr. ..... B26D 3/085 493/354
4,795,414 A * 1/1989 Blumle ..... B26D 3/085 493/241
5,035,683 A * 7/1991 Takeda ..... B31B 50/00 493/178
5,073,162 A 12/1991 Campbell et al.
5,123,891 A * 6/1992 Nieradka ..... F16C 17/06 384/248
5,194,064 A * 3/1993 Simpson ..... B31B 1/00 493/402
5,393,295 A * 2/1995 Knecht ..... B31F 1/10 493/396
5,466,211 A * 11/1995 Komarek ..... B26D 7/27 156/257
5,509,885 A * 4/1996 Brunlid ..... B31F 1/08 493/160
5,690,601 A * 11/1997 Cummings ..... B31F 1/0012 493/340
5,873,807 A * 2/1999 Lauderbaugh ..... B31B 1/00 493/403
5,888,183 A * 3/1999 Ruthenberg ..... B31F 1/10 493/160
5,944,252 A * 8/1999 Connelly ..... B31D 3/005 156/205
6,159,137 A * 12/2000 Lee ..... B26D 7/2621 493/151
6,364,590 B1 * 4/2002 Gayoso ..... B42C 7/005 270/52.08
6,478,725 B1 * 11/2002 Bengt ..... B26D 1/245 493/59
6,508,751 B1 * 1/2003 Weishew ..... B31B 1/00 493/160
7,017,463 B1 * 3/2006 Simpson ..... B26D 7/1818 493/472
7,118,792 B2 * 10/2006 Hewitt ..... B65D 75/5844 229/87.05
7,160,237 B2 * 1/2007 Hashimoto ..... B29C 53/06 493/356
8,088,054 B2 * 1/2012 Gordon ..... B31B 1/25 493/107
8,485,355 B2 * 7/2013 England ..... B65D 5/42 206/259
2005/0039582 A1 * 2/2005 McCluskey ..... B26F 1/20 83/13
2005/0107232 A1 * 5/2005 Petersen ..... B31F 1/0012 493/144
2005/0209076 A1 * 9/2005 Boutron ..... B26D 3/085 493/59
2008/0287276 A1 * 11/2008 Schaack ..... B31F 1/10 493/396
2009/0062094 A1 * 3/2009 Inoue ..... B26D 3/14 493/60
2009/0100978 A1 * 4/2009 von Freden ..... B65H 45/30 83/883
2009/0203509 A1 8/2009 Wiklund
2010/0098354 A1 * 4/2010 Fraser ..... B31B 19/26 383/72
2011/0226847 A1 * 9/2011 Nakano ..... B31F 1/10 229/198.2
2015/0068664 A1 * 3/2015 Stober ..... B31F 1/08 156/73.1

FOREIGN PATENT DOCUMENTS

| | | |
|---|---|---|
| JP | 48-66983 | 12/1971 |
| JP | 49-34406 | 9/1974 |
| JP | 9-48077 | 2/1997 |
| JP | 2004-167971 | 6/2004 |
| JP | 2004-529792 | 9/2004 |
| JP | 2010-284866 | 12/2010 |
| WO | 99/37576 | 7/1999 |
| WO | 02/070241 | 9/2002 |

OTHER PUBLICATIONS

International Search Report dated Jun. 16, 2015 in International (PCT) Application No. PCT/JP2015/064901.
Notice of Reasons for Rejection dated Aug. 18, 2015 in Japanese Application No. 2015-526808, with English translation.
Notice of Reasons for Rejection dated Nov. 10, 2015 in Japanese Application No. 2015-526808, with English translation.
Decision to Grant Patent dated Mar. 8, 2016 in Japanese Application No. 2015-526808, with English translation.
International Preliminary Report on Patentability dated Jan. 3, 2017 in International Application No. PCT/JP2015/064901.
Extended European Search Report dated Sep. 14, 2017 in European Patent Application No. 15834607.2.

* cited by examiner

PRESSED CREASE-FORMING MEMBER

TECHNICAL FIELD

This invention relates to a pressed crease-forming member for forming a crease in a corrugated cardboard sheet or non-corrugated cardboard sheet so that the sheet can be bent along the crease, a template to which is mounted the pressed crease-forming member, and a creasing device.

BACKGROUND ART

Corrugated cardboard sheets, which are each made up of a corrugated medium and liners glued to both sides of the corrugated medium, are available in various types and in different characteristics, according to the height and shape of corrugation of the corrugated medium, the thickness and quality of the corrugated medium, the thickness and quality of the liners, etc.

Such a corrugated cardboard sheet can be formed, by die-cutting, into e.g., a blank $A_1$ shown in FIG. 11, which is to be formed into a corrugated cardboard box. In particular, for this purpose, a template is used which includes a board to which are mounted die-cutting blades for forming the contour of the blank $A_1$ by die cutting, and pressed crease-forming members arranged inside the die-cutting blades and configured to form creases $L_1$, which extend in parallel to the flutes of the corrugated medium, and creases $L_2$, which extend perpendicular to the creases $L_2$, in the blank $A_1$. Using this template, creases can be formed in the blank simultaneously when the blank is formed by die cutting. As the pressed crease-forming members, crease-forming rolls may be used.

The above-mentioned creases $L_1$ extend substantially parallel to the flutes C of the corrugated medium $S_2$ of the corrugated cardboard sheet A, while the creases $L_2$ extend perpendicular to the flutes C of the corrugated medium $S_2$.

FIG. 12 shows a conventional pressed crease-forming member 50 for forming creases $L_1$ and $L_2$. This pressed crease-forming member 50 comprises a strip-shaped base plate 51 made of metal and including a crease-forming portion 52 at one of an opposed pair of rectangular ends, and configured such that by pressing the crease-forming portion 52 into one side of the corrugated cardboard sheet A and partially crushing the corrugation of the corrugated medium $S_2$, groove-shaped creases $L_1$ and $L_2$ can be formed.

According to the characteristics of the corrugated cardboard sheet A, an optimum one is selected from among a plurality of strip-shaped base plates 51 having height dimensions, which are distances between the respective opposed pairs of ends, of about 20-plus millimeters, and having different wall thicknesses, which are distances between the respective two side surfaces, within the range of 0.5 mm to 7.0 mm.

The pressed crease-forming member 50 shown in FIG. 12 is used to form creases $L_1$ and $L_2$ in a corrugated cardboard sheet A having elasticity in the thickness direction thereof by pressing the crease-forming portion 52 into one side of the sheet A and crushing the corrugated medium $S_2$. Because the crease-forming portion 52 has a surface having a convex cross-section and having a smooth circular arc shape with no protrusions and recesses over the entire length thereof, and because the corrugated cardboard sheet A has large elasticity and thus has a tendency to return to its original shape, the creases $L_1$ and $L_2$ are not sufficiently sharp and clear, so that it is difficult to bend the corrugated cardboard sheet A along the creases $L_1$ and $L_2$ with high accuracy.

Especially in forming the creases $L_1$, which extend in parallel to the flutes C of the corrugated medium $S_2$, since different portions of the corrugated medium $S_2$ are crushed by the crease-forming portion 52, and a crease $L_1$ formed at a certain portion of the corrugated medium $S_2$ may be less sharper and clearer than a crease $L_1$ formed at a different portion of the corrugated medium $S_2$. This makes it all the more difficult to bend the corrugated cardboard sheet A with high accuracy.

Since the surface of the crease-forming portion 52 is smooth with no protrusions and recesses over the entire length thereof, especially when forming a crease $L_1$, i.e., a crease extending in parallel to the flutes C, according to the portion of the corrugated medium $\mathbf{8}_2$ crushed by the crease-forming portion 52 to form the crease $L_1$, the surface of the corrugated cardboard sheet A may slip on the surface of the crease-forming portion 52 as the surface of the crease-forming portion 52 is pressed deeper into the corrugated cardboard sheet A, which could cause the sheet A to be moved in the direction perpendicular to the crease $L_1$, thus making it difficult to form the crease $L_1$ at the intended position with high accuracy, or causing the crease $L_1$ to meander.

The blank $A_1$ shown in FIG. 11 is formed into a flat box by bending the blank $A_1$ along two of the three parallel creases $L_1$ on both sides so that a glue tab $P_5$ integrally connected to a panel $P_1$ on one side of the blank $A_1$ is superposed on the end edge of a panel $P_4$ on the other side of the blank $A_1$, and adhesively bonding the superposed portions together.

At that time, if the blank $A_1$ is bent along the above two creases $L_1$ with insufficient accuracy, the panels $P_1$ and the panels $P_4$, which are on the opposite sides of the blank $A_1$, may be inclined relative to each other, or a flat box may not be formed with high accuracy due to inaccurate dimensions of the blank $A_1$ between the above two creases $L_1$. When such a flat box is erected into a rectangular tube, its side walls and/or end walls will be inclined such that the box is distorted with inaccurate inner dimensions.

In order to avoid these problems, the below-identified Patent document 1 proposes to form a V-shaped groove in the crease-forming portion of the pressed crease-forming member at its widthwise center to extend in parallel to one of the opposite long sides of the crease-forming portion, thereby defining a pair of protrusions on the respective sides of the groove. The below-identified Patent document 2 proposes to use two pressed crease-forming members spaced apart from each other so that the two pressed crease-forming members form two protrusions, and pressing the two pressed crease-forming members into a corrugated cardboard sheet.

PRIOR ART DOCUMENTS

Patent Documents

Patent document 1: JP Patent Publication 2010-284866A
Patent document 2: JP Patent Publication 9-48077A

Object of the Invention

In either of Patent documents 1 and 2, the pressed crease-forming member or members are mounted to a template, and a face plate formed with a pair of groove-shaped recesses is mounted on a flat lower board opposed to the template. In order to form a crease in the corrugated cardboard sheet by pushing corrugated cardboard sheet into the groove-shaped recesses with the pair of protrusions of the crease-forming portion or portions, the face plate has to be mounted on the lower board with high accuracy corresponding to the mounting position of the pressed crease-forming member or members on the template. It is therefore extremely troublesome and costly to set these members in position, and also, there is a problem in that the face plate tends to shift as creases are formed repeatedly.

Also, since there are only two protrusions for pressing the corrugated cardboard sheet, especially if a wide crease is formed, a large gap forms between the two protrusions. Since the sheet is not pressed at its portion corresponding to this large gap, the crease formed tends to be less clear if there were not for the groove-shaped recesses in the face plate. Thus in this arrangement, the groove-shaped recesses formed in the face plate are essential elements.

Since recesses and protrusions are formed, respectively, on one and the other surfaces of the corrugated cardboard sheet, the sheet is subjected to a large stress, which could cause the surface of the sheet to be torn, lower the strength of the sheet, or ruin its outer appearance, thereby lowering the commercial value of the sheet.

With the pressed crease-forming member disclosed in Patent document 1, since the groove formed in the widthwise center of the crease-forming portion is a V-shaped groove, the pair of protrusions formed on both sides of the groove have wedge shapes with pointed tips. The corrugated cardboard sheet thus tends to be damaged by the protrusions because high surface pressure is applied to the sheet when the sheet is pressed by the pointed tips of the protrusions.

On the other hand, since the pressed crease-forming member disclosed in Patent document 2 includes two pressed crease-forming members mounted separately to the template to define the protrusions, a difference in height between the protrusions tends to be created. Such a difference in height will cause two creases formed by the two protrusions in a corrugated cardboard sheet to have different depths from each other. This in turn results in the corrugated cardboard sheet being bent along the deeper one of the two creases, thus making it difficult to bend the corrugated cardboard sheet with high accuracy.

Further, the pressed crease-forming member of Patent document 2 could also damage a corrugated cardboard sheet because the pair of protrusions forcibly and strongly pushes the sheet into the groove-shaped grooves of the face plate, which face the respective protrusions. Moreover, the heights of the protrusions may change after many creases are formed. This makes it difficult to form two creases having the same depth in a corrugated cardboard sheet with the two protrusions. Also, since the pressed crease-forming member is constructed from three separate components, it is difficult to form narrow creases.

In either of Patent documents 1 and 2, since no protrusion is provided at the center of the crease-forming portion or each crease-forming portion, the crease or creases formed by such crease-forming portion or portions have no clear centerline, so that the corrugated cardboard sheet cannot be bent along the centerline of the crease or each crease with high accuracy.

SUMMARY OF THE INVENTION

An object of the present invention is to make it possible to form a crease in a corrugated cardboard sheet along which the sheet can be bent with high accuracy, without damaging the sheet.

Means for Achieving the Object

In order to achieve this object, the present invention provides a pressed crease-forming member comprising a strip-shaped base plate made from metal and having a wall thickness of 7.0 mm or less, the strip-shaped base plate including a crease-forming portion at one end of the strip-shaped base plate, the crease-forming portion being capable of forming a crease in a sheet along which the sheet can be bent, by pressing the crease-forming portion into the sheet, wherein the crease-forming portion has a surface on which are formed three or a larger-than-three odd number of ribs extending in a longitudinal direction of the crease-forming portion, the ribs comprising a center rib located at a widthwise center of the crease-forming portion, and the remaining even number of ribs, each half of the remaining even number of ribs being arranged on each side of the center rib, the ribs have tops, of which at least the top of the center rib is chamfered, each of the ribs is formed into a protruding shape by two side surfaces extending toward the top, grooves are formed between the adjacent ribs, the side surfaces of the respective ribs extend from the respective tops of the ribs and are connected to opposed pairs of side surfaces of the grooves, the tops of the ribs are arranged such that with the crease-forming portion facing downward, the top of the center rib is located at the lowest level of all the tops of the ribs, and the tops of the odd number of ribs are formed, as a whole, into a convex shape, and recesses in the form of the grooves and protrusions in the form of the ribs other than the center rib are continuously formed on both sides of a protrusion in the form of the center rib.

When the crease-forming portion of this pressed crease-forming member is pressed against a sheet such as a corrugated cardboard sheet, the top of the center rib first abuts and is pressed into the sheet, so that the sheet is crushed, and the surface of the sheet moves along both side surfaces of the center rib and into the grooves of the crease-forming portion on both sides of the center rib. Then, the tops of the ribs on both sides of the center rib abut and are pressed into the sheet in a sequential order, so that the surface of the sheet is smoothly brought, one after another, into abutment with both side surfaces of the respective ribs on both sides of the center rib. As a result, a corrugated crease is formed in the sheet by the crease-forming portion.

While the crease is being formed by the crease-forming portion, the sheet will never shift on the surface of the crease-forming portion toward either side of the center rib, so that a straight groove is formed in the sheet by the center rib at the accurate position.

Since the surface of the crease-forming portion includes protrusions in the form of the ribs, and recesses in the form of the grooves which are arranged alternately and continuously with the ribs, thus forming a corrugated shape, the crease-forming portion is brought into contact with the surface of the sheet over a large surface area. This prevents the surface of the sheet from shifting relative to the surface of the crease-forming portion.

Since the sheet is brought into abutment with the protrusions and recesses on the surface of the crease-forming portion in a smooth sequential order, the sheet will never be torn when forming a crease in the sheet.

Straight grooves are formed in the sheet at its portions corresponding to the respective ribs of the crease-forming portion, and clear and sharp ribs are formed on the sheet at its portion corresponding to the respective grooves of the crease-forming portion so as to alternate with the straight grooves. The straight grooves and the ribs thus form a straight crease.

Although the sheet is pushed with a strong force by the center rib, since its top is chamfered, the crease-forming portion can form a crease in the sheet without damaging the sheet.

When forming a crease, the odd number of ribs are pushed one after another into the sheet with the center rib first, so that the center rib is pressed harder into the sheet than are the ribs on both sides of the center rib. This makes it possible to form a very deep, clear and sharp straight groove at the widthwise center of the groove bottom of the crease.

By the crease-forming portion, which is, as a whole, formed into a smooth corrugated convex shape by the protrusions and the recesses, a crease which is concave and complementary in shape to the convex shape of the crease-forming portion is formed.

Thus, when the sheet is bent along the crease, the sheet is bent with the clear and sharp straight groove at the widthwise center of the groove bottom of the crease as a starting point, so that the sheet can be bent with high accuracy.

Since the top of the center rib protrudes beyond the tops of the ribs other than the center rib, a sharper straight groove is formed at the widthwise center of the groove bottom of the crease, so that the sheet can be bent accurately with this straight groove as a starting point.

Since the tops of the ribs other than the center rib are in contact, from inside, with a smooth, convex, arc-shaped first imaginary curved line which is symmetric with respect to a centerline and high at a center, the tops of the ribs of the crease-forming portion can be easily formed. Also, it is possible to form a crease which is symmetrical with respect to the centerline and which is concave and complementary in shape to the convex shape of the crease-forming portion, which is smooth as a whole.

Since the two side surfaces of at least the center rib are smooth inclined surfaces inclined in opposite directions to each other and having no corners such that at least the center rib is tapered, the sheet can smoothly move along the inclined surfaces into the grooves on both sides of the center rib, so that a clear, V-shaped, straight groove is formed at the center of the crease. This makes it possible to accurately bend the sheet along the center of the crease.

Since, with the crease-forming portion facing downward, the tops of the ribs on both sides of the center rib are arranged such that the farther away each of the ribs on both sides of the center rib is from the center rib toward each side of the crease-forming portion, the higher the top thereof is, the tops of the ribs on both sides of the center rib are brought into abutment with the sheet in a smooth sequential order such that a portion of the sheet closer to the center of the crease formed is crushed more strongly, so that the sheet is less likely to be torn while a crease is being formed. Also, this makes it possible to bend the sheet accurately along the center of the crease.

In order to achieve the above object, in a crease-forming template comprising a board which comprises plywood, and a pressed crease-forming member mounted to the board, and capable of forming a groove-shaped crease in a sheet along which the sheet can be bent, by pressing the pressed crease-forming member into the sheet, the pressed crease-forming member according to the present invention is used as the above pressed crease-forming member. By using the crease-forming member according to the present invention, a crease can be formed accurately in the sheet.

In order to achieve the above object, in a creasing device comprising a support member, and a template opposed to the support member and including a board comprising plywood and a pressed-crease forming member mounted to the board, the creasing device being configured to form a groove-shaped crease in a sheet along which the sheet can be bent, by moving the template and the support member toward each other with the sheet supported on the support member, thereby pressing the pressed crease-forming member into the sheet, the template according to the present invention is used as the above template.

In order to achieve the above object, in a creasing device comprising an anvil roll, a die roll opposed to the anvil roll, and a template mounted to an outer periphery of the die roll and including a cylindrical board comprising plywood, and a pressed crease-forming member mounted to the board, the creasing device being configured such that the pressed crease-forming member is capable of forming a groove-shaped crease in a sheet along which the sheet can be bent, when the sheet is fed into between the anvil roll and the die roll, the pressed crease-forming member according to the present invention is used as the above pressed crease-forming member.

In order to achieve this object, the present invention also provides a creasing device comprising a support roll and a crease-forming roll which are configured to be rotated in opposite directions to each other, wherein the crease-forming roll includes a crease-forming portion including, on an outer periphery of the crease-forming portion, an annular crease-forming ring, the creasing device being configured such that the crease-forming ring forms a groove-shaped crease in a sheet along which the sheet can be bent, when the sheet is fed into between the support roll and the crease-forming roll, wherein the crease-forming ring has an outer peripheral surface on which are formed three or a larger-than-three odd number of annular ribs extending in a circumferential direction of the crease-forming ring, the annular ribs comprising an annular center rib located at a widthwise center of the crease-forming portion, and the remaining even number of annular ribs, each half of the remaining even number of annular ribs being arranged on each side of the annular center rib, the annular ribs have tops, of which at least the top of the annular center rib is chamfered, each of the annular ribs is formed into a protruding shape by two side surfaces extending toward the top, circumferential grooves are formed between the adjacent annular ribs, the side surfaces of the respective annular ribs extend from the respective tops of the annular ribs and are connected to opposed pairs of side surfaces of the circumferential grooves, each of the circumferential grooves is formed into a recessed shape by each pair of the side surfaces of the circumferential grooves, the tops of the annular ribs are arranged such that the top of the annular center rib is largest in outer diameter of all the tops of the annular ribs, and the tops of the odd number of ribs are formed, as a whole, into a convex shape, and recesses in the form of the circumferential grooves and protrusions in the form of the annular ribs other than the annular center rib are continuously formed on both sides of a protrusion in the form of the annular center rib.

Advantages of the Invention

In any of the inventions directed to a pressed crease-forming member, a crease-forming template, and a creasing device, the top of the center rib first abuts and is pressed into the sheet, so that the sheet is crushed, and the surface of the sheet moves along both side surfaces of the center rib and into the grooves of the crease-forming portion on both sides of the center rib. Then, the tops of the ribs on both sides of the center rib abut and are pressed into the sheets in a sequential order, so that the sheet is smoothly brought, one after another, into abutment with both side surfaces of the respective ribs on both sides of the center rib. As a result, a corrugated crease is formed in the sheet by the crease-forming portion.

While the crease is being formed by the crease-forming portion, the sheet will never shift on the surface of the crease-forming portion toward either side of the center rib, so that a straight groove is formed in the sheet by the center rib at the accurate position. This makes it possible to accurately bend the sheet.

Since the surface of the crease-forming portion includes protrusions in the form of the ribs, and recesses in the form of the circumferential grooves which are arranged alternately and continuously with the ribs, thus forming a corrugated shape, the crease-forming portion is brought into contact with the surface of the sheet over a large surface area. This prevents the surface of the sheet from shifting relative to the surface of the crease-forming portion.

Since the center rib is pushed more strongly than are the ribs on both sides of the center rib, thus weakening the sheet, a very deep, clear and sharp straight groove is formed at the widthwise center of the groove bottom of the crease. This makes it possible to accurately bend the sheet along the center of the crease.

Since the sheet is brought into abutment with the protrusions and recesses on the surface of the crease-forming portion in a smooth sequential order, the sheet will never be torn when forming a crease in the sheet.

Since a portion of the sheet closer to the center of the crease formed is crushed more strongly, the sheet is less likely to be torn while a crease is being formed. Also, this makes it possible to bend the sheet accurately along the center of the crease.

Although the sheet is pushed with a strong force by the center rib, since its top is chamfered, the crease-forming portion can form a crease in the sheet without damaging the sheet.

Since the tops of the ribs are arranged such that with the crease-forming portion facing downward, the top of the center rib is located at the lowest level of all the tops of the ribs, and the tops of the odd number of ribs are formed, as a whole, into a convex shape, by the crease-forming portion, which is, as a whole, formed into a smooth corrugated convex shape by the protrusions and the recesses, a crease which is concave and complementary in shape to the convex shape of the crease-forming portion is formed. This makes it possible to accurately bend the sheet along the widthwise center of the crease.

BEST MODE FOR EMBODYING THE INVENTION

Figure 1A:
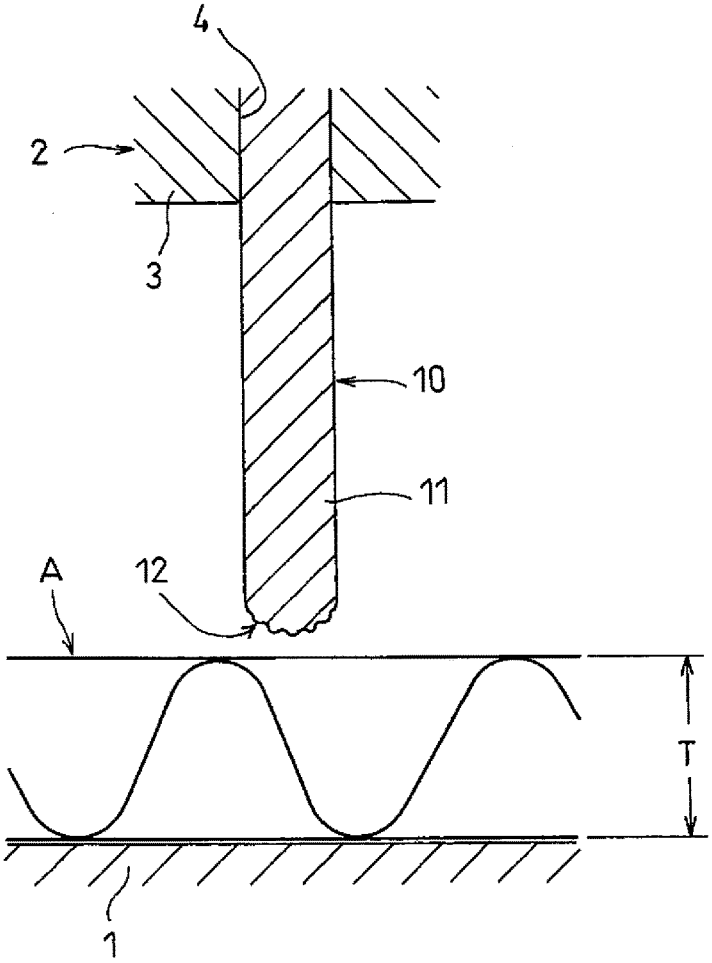
FIG. 1(A) is a vertical sectional view of a creasing device according to the present invention.
Figure 1B:
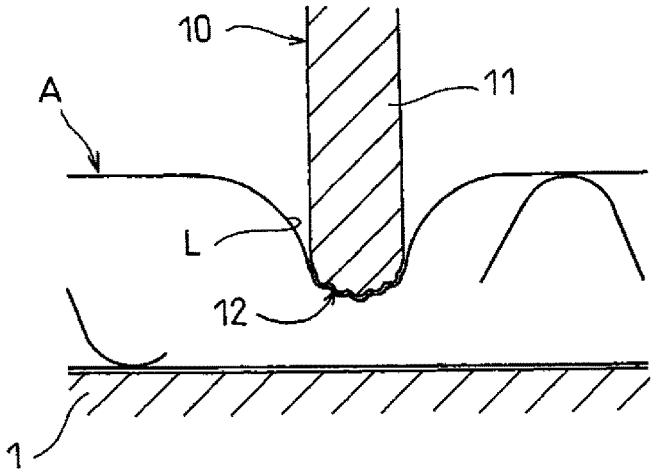
FIG. 1(B) is a vertical sectional view of the creasing device, showing how a crease is formed.

An embodiment of the present invention is described with reference to the drawings. FIGS. 1A and 1B show a creasing device for forming creases in a corrugated cardboard sheet. The creasing device includes a support member or support plate 1 having a flat surface (i.e., a surface with no recesses and protrusions) and capable of supporting a corrugated cardboard sheet A. The creasing device further includes a template 2 opposed to, and movable toward and away from, the support plate 1. The template 2 includes a flat board 3 comprising plywood and having a groove-like mounting hole 4 formed, e.g., by a laser beam, and a pressed crease-forming member 10 press-fitted into the mounting hole 4 in the height direction of the creasing device.

Figure 2:
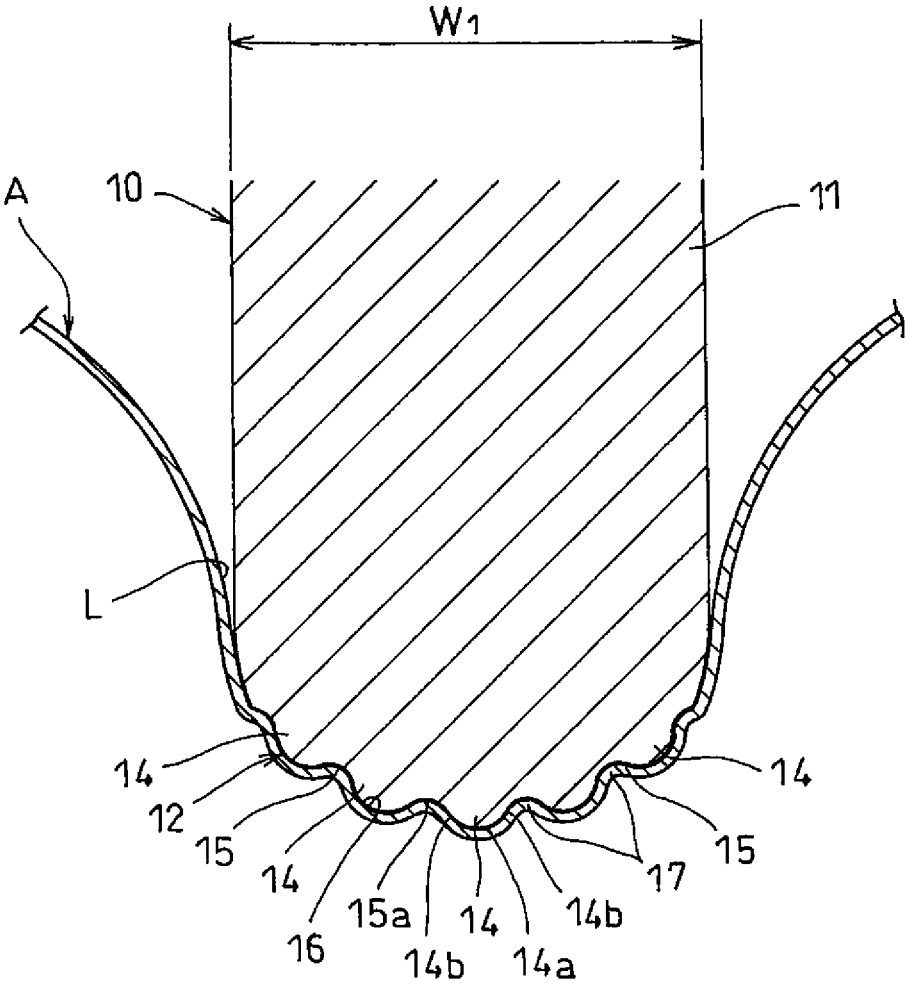
FIG. 2 is an enlarged sectional view of a portion of FIG. 1(B).
Figure 3:
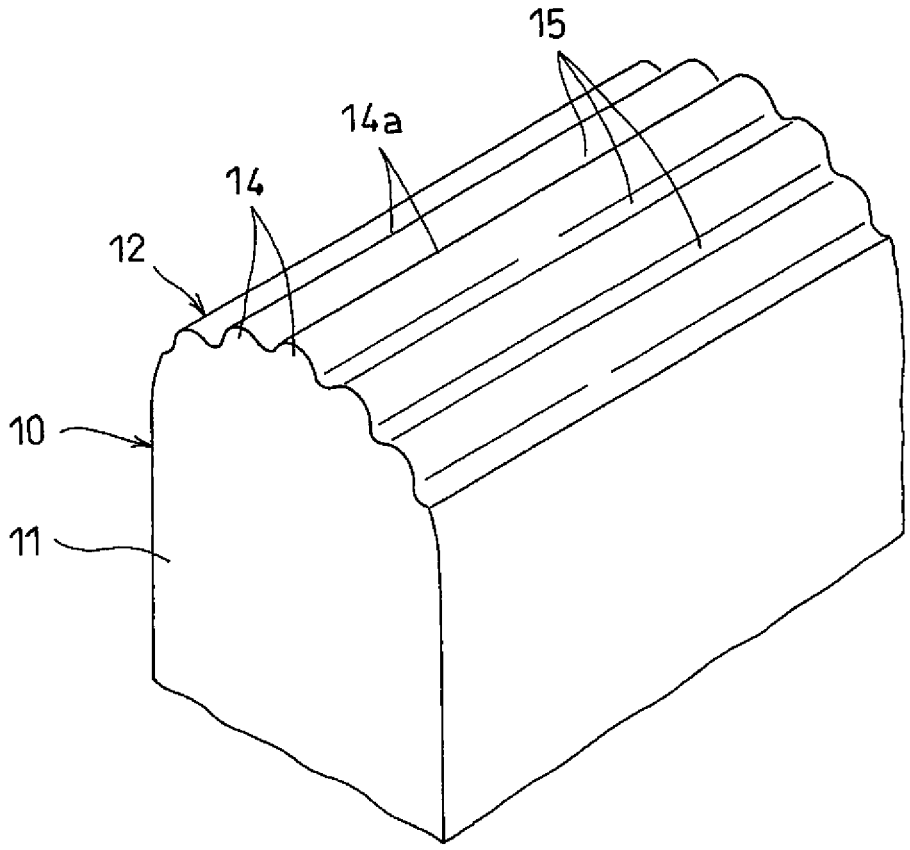
FIG. 3 is a perspective view of a portion of a pressed crease-forming member shown in FIG. 2.
Figure 4:
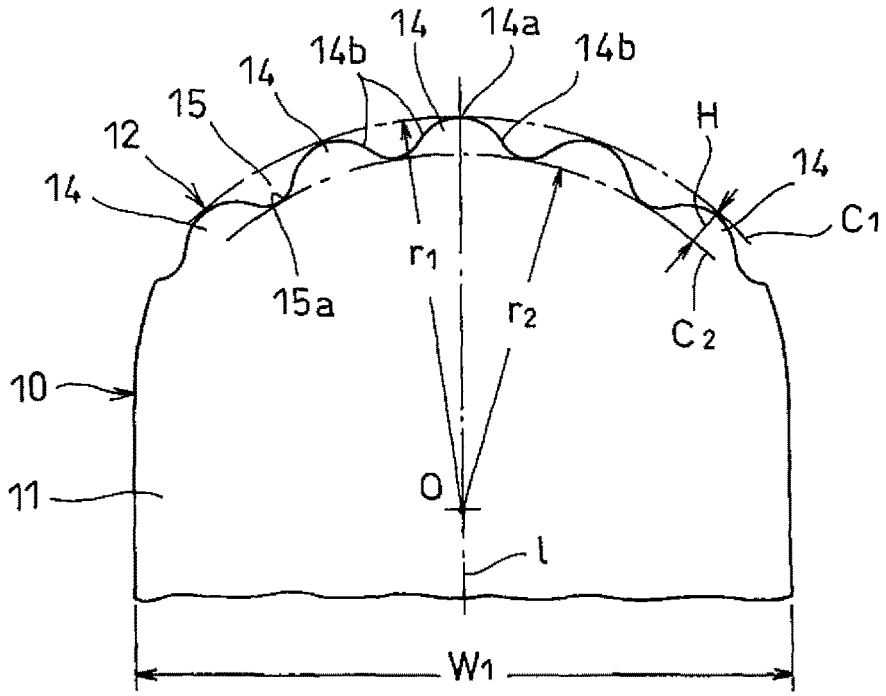
FIG. 4 is a front view of FIG. 3.

As shown in FIGS. 2 to 4, the pressed crease-forming member 10 is a strip-shaped base plate 11 made from metal and having a height, which is the distance between the vertically opposed rectangular ends of the member 10, of about 20-plus millimeters, a wall thickness $W_1$, which is the distance between the two side surfaces of the member 10, of about 0.5 mm-7.0 mm, and having a suitable length. One of the upper and lower rectangular end portions of the strip-shaped base plate 11 is used as a crease-forming portion 12. As this pressed crease-forming member 10, one having suitable dimensions is selected and used according to the characteristics of the corrugated cardboard sheet A.

The crease-forming portion 12 has a plurality of protruding ribs 14 extending in the longitudinal direction of the crease-forming portion 12. In the embodiment, five such ribs 14 are provided, with one of the five ribs 14 (which is hereinafter referred to as the "center rib 14") positioned on the widthwise center of the crease-forming portion 12, and two each of the remaining four ribs 14 positioned on either side of the center rib 14, so that the ribs 14 are arranged symmetrically with respect to the widthwise centerline of the crease-forming portion 12.

Similarly, three or a larger-than-three odd number (other than five) of ribs 14 may be provided, with one of them positioned on the widthwise center of the crease-forming portion 12, and each half of the remaining even number of ribs positioned on either side of the center rib, so that the ribs are arranged symmetrically with respect to the widthwise centerline of the crease-forming portion 12. The number of ribs 14 should be determined taking into consideration the wall thickness of the strip-shaped base plate 11, and the properties and material of the corrugated cardboard sheet A.

Each rib 14 has two straight inclined side surfaces 14*b* which are inclined in opposite directions to each other and extend to its top 14*a* so that the rib 14 has a substantially V-shaped cross-section tapered toward the top 14*a*.

In the embodiment, the top 14*a* of each rib 14 is chamfered so as to have a circular arc-shaped cross-section, but it may be chamfered so as to have a polygonal cross-section.

Also, at least the top 14*a* of the center rib 14, and not all of the tops 14*a*, may be chamfered.

The center rib 14 and the ribs 14 on both sides of the center rib 14 are all narrow in width and substantially equal in width to each other. The widths of the tops 14*a* are determined according to the wall thickness $W_1$ of the strip-shaped base plate 11 and the number of ribs 14, and are about one-third of the wall thickness W1 (which is 0.5 mm-7.0 mm).

Both inclined surfaces (side surfaces) of each rib 14 would be easily formable if they are smooth straight surfaces having no corners, but they may be smoothly curved or corrugated inclined surfaces having no corners so that the rib 14 is tapered toward the top 14*a*.

When both side surfaces 14*b* of each rib 14, which extend to the top 14*a*, are inclined surfaces inclined in opposite directions to each other to form an acute angle therebetween, a sharper crease L can be formed in the corrugated cardboard sheet A, but they may be arranged to form an obtuse angle therebetween. By arranging the side surfaces 14*b* to form an obtuse angle therebetween, the rib 14 is less likely to damage the corrugated cardboard sheet A.

When the side surfaces 14*b* of each rib 14 are inclined surfaces, the corrugated cardboard sheet A can be more easily formed along the inclined surfaces, but they may be vertically extending surfaces. By arranging the side surfaces 14*b* to extend vertically, a shaper crease L can be formed in the corrugated cardboard sheet A.

The inclined side surfaces 14*b* of each adjacent pair of the ribs 14 that are opposed to each other extend away from the respective tops 14*a*, and are continuously connected to inclined surfaces 14*b* inclined in opposite directions to each other. The latter two inclined side surfaces 14*b*, which extend smoothly in a straight line and have no corners, form a V-shaped concave groove 15 which is tapered toward its bottom and continuous with the ribs 14 on both sides of the groove 15.

The bottoms of the concave grooves 15 are chamfered so as to have a rounded cross-section, but may be chamfered so as to have a polygonal cross-section.

If the grooves 15 are deep, the corrugated cardboard sheet A may not reach the bottoms of the grooves 15. In such a case, the bottoms of the grooves 15 may not be chamfered.

Both inclined surfaces of each groove 15 would be easily formable if they are smooth straight surfaces having no corners, but they may be smoothly curved or corrugated inclined surfaces having no corners so that the groove 15 is tapered toward the bottom.

As described above, since the side surfaces 14*b* of the ribs 14 are smoothly connected to the respective side surfaces 14*b* of the grooves 15 with no corners therebetween so that the side surfaces 14*b* continuously extend from the tops 14*a* of the ribs 14 to the bottoms of the grooves 15, the crease-forming portion 12 has a smooth continuous surface comprising the protrusions in the form of the ribs 14, and the recesses in the form of the grooves 15 which alternate with the protrusions, with the center rib 14 protruding beyond the other ribs 14.

The crease-forming portion 12 of the strip-shaped base plate 11 is shaped such that with the strip-shaped base plate 11 in the crease-forming position, in which the crease-forming portion 12 faces downward, the top 14*a* of the center rib 14, which is positioned on the widthwise center of the crease-forming portion 12, is located at the lowest level, with the tops 14*a* of the ribs 14 on both sides of the center rib 14 located such that the farther apart these tops 14*a* are from the top 14*a* of the center rib 14, the higher they are located, whereby the tops 14*a* of all of the ribs 14, which are spaced apart from each other in the width direction, are formed into a downwardly convex shape as a whole, with the center rib 14, which protrudes beyond the other ribs 14, located at the center.

When the center rib 14 protrudes downward beyond the other ribs 14, instead of arranging the tops 14*a* of the ribs 14 on both sides of the center rib 14 such that the farther away these tops 14*a* are from the top 14*a* of the center rib 14, the higher they are located, some of these tops 14*a* may be of the same height such that the tops 14*a* are formed into a downwardly convex shape as a whole.

In order to arrange the tops 14*a* of the odd number of ribs 14 so as to be formed into a convex shape as a whole, in FIG. 4, the odd number of ribs 14 are radially arranged about a point O on a widthwise centerline l extending parallel to the side surfaces of the strip-shaped base plate 11 while passing through the widthwise center of the crease-forming portion 12 so as to be symmetrical with respect to the centerline l, with the tops 14*a* of the ribs 14 other than the center rib 14 in contact, from inside, with a reference line corresponding to the height positions of the tops 14*a*, which form the convex shape of the crease-forming portion 12, the reference line being an imaginary, smooth, convex, circular arc-shaped circumcircle $C_1$ whose center is at point O, which is in contact with the apex of the top 14*a* of the center rib 14, and which is high at its center and symmetrical with respect to the centerline I. In other words, the tops 14*a* of all of the odd number of ribs 14 are located within the circumcircle $C_1$ or reference line. Thus, in FIG. 4, the tops 14*a* of the ribs 14, which are spaced apart from each other in the width direction, are in contact with the circumcircle $C_1$ or reference line so as to be formed into a smooth convex shape which is symmetrical with respect to the centerline l, as a whole.

With this arrangement, since the ribs 14 are radially arranged about the point O, the crease-forming portion 12 can be manufactured easily.

The circumcircle $C_1$, whose center is at point O, has a radius $r_1$ which is equal to or larger than half the wall thickness $W_1$ of the strip-shaped base plate 11 ($r_1 \geq W_1/2$).

Also in FIG. 4, the plurality of grooves 15, which are formed between the respective adjacent pairs of the odd number of ribs 14, are of the same depth, and an imaginary, convex, smooth, circular arc-shaped inscribed circle $C_2$ which the apexes of the groove bottoms 15*a* of the respective grooves 15 contact from outside, and which is high at its center while being symmetrical with respect to the center line l, has a center located at the center O of the circumcircle $C_1$, the inscribed circle $C_2$ being a reference line corresponding to the height positions of the groove bottoms 15*a*, which form the convex shape of the crease-forming portion 12, whereby the heights H from the inscribed circle $C_2$ to the apexes of the tops 14*a* of the respective odd number of ribs 14, namely, the protruding amounts of the ribs 14, namely, the heights (depths) of the grooves 15 are all equal to each other. The inscribed circle $C_2$ has a radius $r_2$. Thus, as a whole, the groove bottoms 15*a* of the grooves 15, which are spaced apart from each other in the width direction, form a convex shape symmetrical with respect to the centerline l.

As described above, since ribs 14 each having a top 14*a* which is rounded by chamfering, and inclined side surfaces 14*b* which are inclined in opposite directions to each other are arranged alternately and continuously with V-shaped grooves 15 each having a groove bottom 15*a* which is rounded by chamfering, and inclined side surfaces, the ribs 14 and the grooves 15 form a smooth and orderly corrugated shape having no corners, with the ribs 14 and the grooves 15 in contact with the circumcircle $C_1$ and the inscribed circle $C_2$, respectively, thus forming, as a whole, a smooth convex shape symmetrical with respect to the centerline I, on the surface of the crease-forming portion 12.

Since the tops 14*a* of the ribs 14 and the groove bottoms 15*a* of the grooves 15 are in contact with the circumcircle $C_1$ and the inscribed circle $C_2$, respectively, the tops 14*a* and the groove bottoms 15*a* can be easily formed on the crease-forming portion 12 such that the crease-forming portion 12 is formed, as a whole, into a smooth convex shape which is symmetrical with respect to the centerline.

Since the pressed crease-forming member 10 comprises a single integral strip-shaped base plate 11 made from a metal, it has the following advantages:

(1) Since the pressed crease-forming member 10 is manufactured by cutting one end of the single integral strip-shaped base plate 11, even if the strip-shaped base plate 11 is narrow in width, an odd number of ribs 14 and grooves 15 can be easily formed so as to be smoothly continuous with each other.

(2) The pressed crease-forming member 10 can be easily mounted to the template 2 while being positioned accurately.

(3) Once the pressed crease-forming member 10 comes into abutment with the support plate 1, the tips of the odd number of ribs 14 are less likely to be displaced from each other, so that relative displacement is prevented.

(4) Since the pressed crease-forming member 10 is made from a metal, it is less likely to become worn, and less likely to be deformed in shape. The corrugated cardboard sheet A can thus be crushed strongly.

With this creasing device, when, as shown in FIG. 1(A), the template 2 is lowered toward the flat support plate 1, which is provided under and opposed to the template 2, with the corrugated cardboard sheet A supported on the support plate 1, as shown in FIG. 1B, the crease-forming portion 12 of the pressed crease-forming member 10 presses the corrugated cardboard sheet A and crushes the corrugated cardboard sheet A, thus forming a deep crease L in the corrugated cardboard sheet A.

At that time, the plurality of ribs 14 on the crease-forming portion 12 press the corrugated cardboard sheet A in a sequential order with the center rib 14 provided at the widthwise center of the crease-forming portion 12 first and toward the respective ribs 14 on both sides thereof. When the corrugated cardboard sheet A is pressed, the corrugated cardboard sheet A moves away from the ribs 14 such that the corrugated cardboard sheet A bulges into the V-shaped grooves 15, which are adjacent to the ribs 14. The corrugated cardboard sheet A is thus formed by the crease-forming portion 12.

Thus, since, as shown in FIG. 2, the corrugated cardboard sheet A is pressed by the plurality of ribs 14 on the crease-forming portion 12, of which the surface is formed into a smooth convex shape symmetrical with respect to the centerline by a smooth and orderly corrugation comprising recesses and protrusions, such that the corrugated cardboard sheet A moves sequentially into the respective grooves 15, even if a crease L is to be formed to extend parallel to the flutes C, the corrugated cardboard sheet A will never be displaced or moved relative to the surface of the crease-forming portion 12. Thus, a plurality of straight, substantially V-shaped, radially arranged grooves 16 having rounded bottoms are clearly and sharply formed in the corrugated cardboard sheet A at its portions corresponding to the respective ribs 14, while a plurality of straight, radially arranged ribs 17 are clearly and sharply formed by rounded convex bulges formed on the portions of the corrugated cardboard sheet A corresponding to the grooves 15 of the crease-forming portion 12, of which the groove bottoms 15*a* are rounded. Thus, as a whole, a smooth, groove-shaped concave crease L symmetrical with respect to the centerline and complementary in shape to the crease-forming portion 12 is clearly and sharply formed in the corrugated cardboard sheet A by the grooves 16 and the ribs 17, which form a smooth and orderly corrugation. Since the side surfaces of the ribs 14 and the grooves 15 are inclined surfaces, the crease L is formed smoothly in the corrugated cardboard sheet A when the corrugated cardboard sheet A is pressed by the crease-forming portion 12.

In the embodiment, the two side surfaces of each of the odd number of ribs 14 are inclined in opposite directions to each other, but the side surfaces of at least only the center rib 14, of the odd number of ribs 14, may be inclined in opposite directions to each other so as to have no corners so that at least only the center rib 14 is tapered toward its top. In this case too, the corrugated cardboard sheet A smoothly and effortlessly moves into the grooves 15 along the inclined surfaces, and as a result, a V-shaped, straight groove 16 is formed clearly and sharply at the widthwise center of the crease L, which makes it possible to accurately bend the corrugated cardboard sheet A along the center of the crease L.

Since the ribs 14 and the grooves 15 are radially arranged about the point O, when the crease-forming portion 12 is pressed into the corrugated cardboard sheet A, the surface of the corrugated cardboard sheet A is easily moved along the corrugated shape on the surface of the crease-forming portion 12, so that the crease L can be smoothly formed. Since the ribs 14 are narrow in width, the grooves 16 formed by the ribs 14 are also narrow in width and thus sharp and clear.

Figure 5:
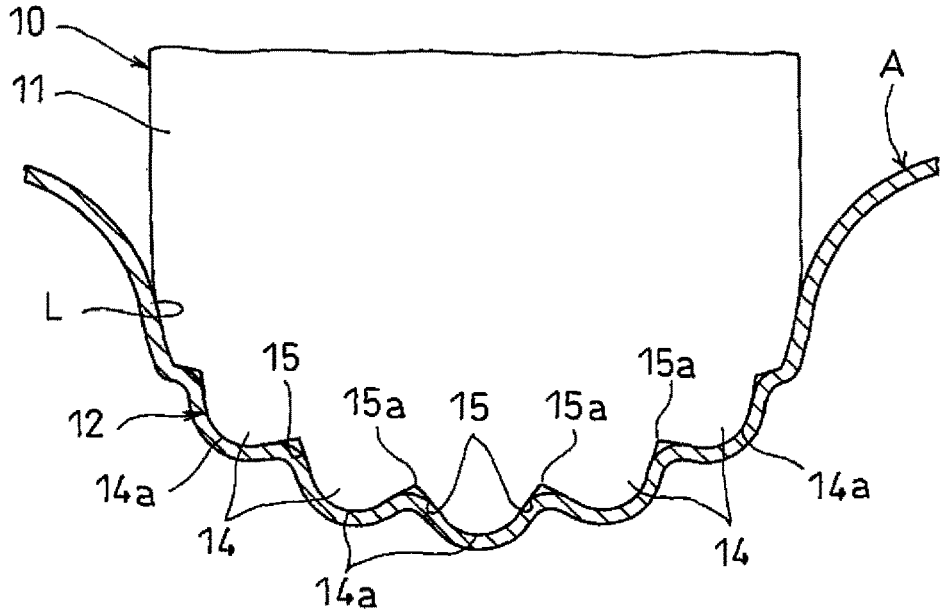
FIG. 5 is a front view of a different pressed crease-forming member according to the present invention.

The corrugated cardboard sheet A is not pushed so hard by the grooves 15 of the crease-forming portion 12, and especially if the grooves 15 are deep, the portions of the corrugated cardboard sheet A that have entered the grooves 15 will not reach the bottoms of the grooves 15. Thus, even if, as shown in FIG. 5, the groove bottoms 15*a* are V-shaped and pointed, the crease-forming portion 12 will not damage the corrugated cardboard sheet A, and the grooves 16 formed will have rounded bottoms.

Since the entire crease-forming portion 12 is pressed into the corrugated cardboard sheet A, a groove-shaped crease L corresponding to the wall thickness $W_1$ of the strip-shaped base plate 11 is formed in the corrugated cardboard sheet A, and the crease L has a groove bottom having a stripe pattern comprising a plurality of grooves 16 and ribs 17 alternating with the grooves 16.

Since the odd number of ribs 14 forming, as a whole, the convex surface of the crease-forming portion 12 press the corrugated cardboard sheet A in a sequential order with the center rib 14 provided at the widthwise center of the crease-forming portion 12 first and toward the respective ribs 14 on both sides thereof, the center rib 14 presses the corrugated cardboard sheet A harder than the other ribs 14.

Thus, the closer each groove 16 is to the center of the crease L and thus the farther apart from the respective side of the crease L, the thinner and thus the weaker in strength the corrugated cardboard sheet A is at its portion where this groove 16 is formed. This means that the groove 16 at the widthwise center of the groove bottom of the crease L is the clearest and sharpest of all the grooves 16. Further, since the groove bottom of the crease L forms an orderly corrugated shape symmetrical with respect to the centerline, when bending the corrugated cardboard sheet A along the crease L, the corrugated cardboard sheet A begins to bend along the groove 16 at the widthwise center of the groove bottom of the crease L, so that the corrugated cardboard sheet A can be bent with high accuracy.

Since the closer to the widthwise center of the crease L, the more strongly the corrugated cardboard sheet A is crushed, and also, since the groove bottoms of the grooves 16 of the crease L form a smooth corrugated shape with no corners, even if the corrugated cardboard sheet A is bent by 180 degrees along the crease L, inner surfaces of both sides of the crease L will not strongly abut each other in such a manner as to interfere with bending of the sheet A, or cause breakage of groove bottoms.

Since the grooves 16 and the ribs 17 are formed so as to be radially arranged, corresponding to the radially arranged ribs 14 and grooves 15, respectively, the corrugated cardboard sheet A is more likely to be bent along the widthwise center of the groove bottom of the crease L.

Since the plurality of ribs 14, which are to be pressed into the corrugated cardboard sheet A, have their tops 14*a* rounded by chamfering, they will not damage the corrugated cardboard sheet A even when they are pressed hard into the corrugated cardboard sheet A.

Since the crease L is formed in the corrugated cardboard sheet A by the crease-forming portion 12, of which the surface is, as a whole, formed into a smooth convex shape symmetrical with respect to the centerline, and of which the ribs 14 and the groove 15 are arranged alternately with each other such that they form a smooth and orderly corrugation, the groove bottom of the crease L is formed into a clear, smooth, orderly corrugation having no corners by the grooves 16 and the ribs 17, corresponding to the shape of the surface of the crease-forming portion 12, with the groove 16 at the widthwise center forming the clearest and sharpest recess, whereby the groove bottom of the crease L is formed, as a whole, into a concave shape complementary in shape to the downwardly-facing smooth crease-forming portion 12. Thus, the corrugated cardboard sheet A will not be damaged or broken, and can be bent accurately and easily with the apex of the groove 16 at the widthwise center of the groove bottom as a starting point. Since the groove bottom has no corners, the corrugated cardboard sheet A will never be bent at a portion other than the widthwise center of the crease L.

Since the surface of the support plate 1 is flat, no excessive force will act on the corrugated cardboard sheet A even if the pressed crease-forming member 10 is pressed hard into the sheet A, so that the sheet A will never be broken.

Since an odd number of the ribs 14 are provided, this pressed crease-forming member 10 can be especially advantageously used to form creases L in corrugated cardboard sheets A and cardboard, which have large wall thicknesses, by pressing it into them.

If the heights H, shown in FIG. 4, of the ribs 14 are lower than necessary, it may be impossible to form clear and sharp grooves 16, while if the heights H are higher than necessary, the curvature of the tops 14*a* may be so small that the tops 14*a* could damage the corrugated cardboard sheet A.

Thus, while also depending on the characteristics of the corrugated cardboard sheet A and the wall thickness $W_1$ of the strip-shaped base plate 11, the heights H of the ribs 14 are most preferably about 0.1 mm, and should be within the range of 0.05 mm-1.0 mm.

The number of the ribs 14 is preferably an odd number within the range of three to 21, though dependent on the characteristics of the corrugated cardboard sheet A and the wall thickness $W_1$ of the strip-shaped base plate 11. For example, if the wall thickness $W_1$ is 3.0 mm, the number of the ribs 14 is preferably seven or around seven.

There are various corrugated cardboard sheets A which are different in characteristics, and if the wall thickness $W_1$ of the strip-shaped base plate 11 is larger than the thickness T of the corrugated cardboard sheet A, the crease L formed will have a width larger than necessary to such an extent that it is difficult to clearly specify the bending position, i.e., to bend the sheet A with high accuracy. This will make it difficult to prepare boxes whose inner dimensions are constant by bending such corrugated cardboard sheets A. Thus, the strip-shaped base plate 11 preferably satisfies the relation $W_1<T$.

Figure 6:
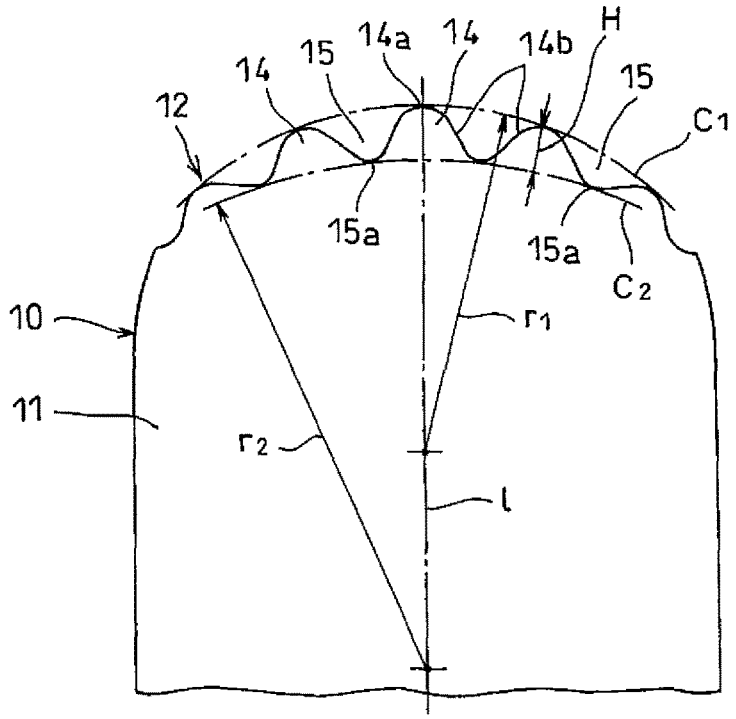
FIG. 6 is a front view of a still different pressed crease-forming member according to the present invention.

In FIG. 4, each rib 14 has a height H from the inscribed circle $C_2$ to the apex of its top 14*a* (and thus the protruding amount of the rib 14, as well as the depth of the corresponding groove 15) that is equal to the heights H of the other ribs 14. However, provided the number of the ribs 14 is an odd number, and the surface of the crease-forming portion 12 is formed, as a whole, into a smooth corrugated convex shaped which are symmetrical with respect to the centerline, as shown in FIG. 6, the inscribed circle $C_2$, which is in contact with the groove bottoms 15*a* of the respective grooves 15, may have a radius $r_2$ larger than the radius $r_1$ of the circumcircle $C_1$, which is in contact with the tops 14*a* of the respective ribs 14 such that the heights H of the ribs 14, namely the protruding amounts of the tops 14*a*, gradually decrease from the rib 14 at the widthwise center of the crease-forming portion 12 toward the ribs 14 on both sides of the crease-forming portion 12. When the tops 14*a* are arranged in this manner, and symmetrical with respect to the centerline, the groove bottoms 15*a* may be provided at different height positions, instead of being arranging on a circular arc.

Figure 7:
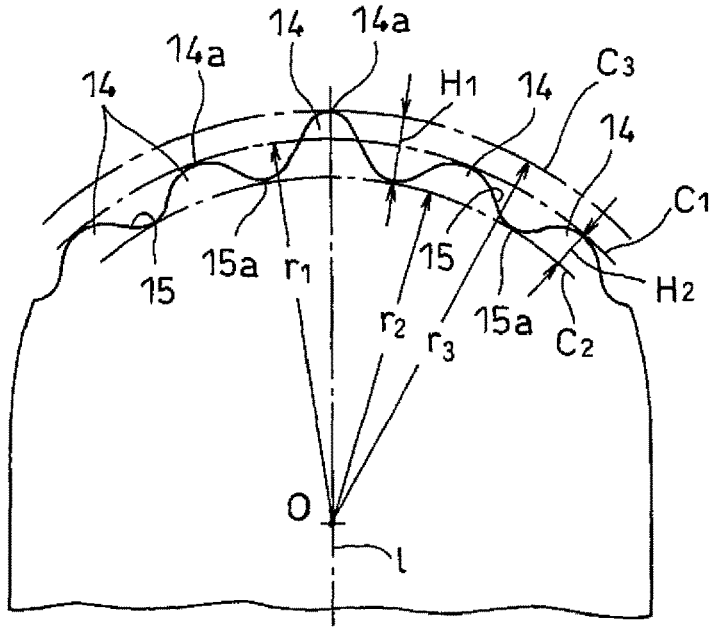
FIG. 7 is a front view of a further different pressed crease-forming member according to the present invention.

Further alternatively, as shown in FIG. 7, the center rib 14, which is located at the widthwise center of the crease-forming portion 12, may be arranged such that the apex of its top 14*a* contacts, from inside, a circumcircle $C_3$ having a radius $r_3$ larger than the radius $r_1$ of the circumcircle $C_1$, which is in contact, from inside, with the apexes of the tops 14*a* of the ribs 14 on both sides of the center rib 14, and having a center O on the center axis on which the center O of the circumcircle $C_1$ is located, whereby only the center rib 14 protrudes outwardly beyond the circumcircle $C_1$, that is, the height (protruding amount) $H_1$ from the inscribed circle $C_2$, with which the groove bottoms 15*a* of the grooves 15 are in contact from outside, to the apex of the top 14*a* of the center rib 14 is higher than the heights (protruding amounts) $H_2$ from the inscribed circle $C_2$ to the apexes of the tops 14*a* of the ribs 14 on both sides of the center rib 14.

If the protruding amount of the center rib 14 beyond the ribs 14 on both sides of the center rib 14 (namely, $H_1$-$H_2$) is too small, the groove 16 formed by the center rib 14 is too shallow and less clear, while if too large, the center rib 14 could tear the corrugated cardboard sheet A at its portion where there is the groove 16. Thus, this protruding amount H1-H2 is preferably set to a value within 0.05 mm-0.3 mm dependent on the characteristics and thickness of the corrugated cardboard sheet A.

As shown in FIG. 7, when the height $H_1$ or protruding amount of the center rib 14, which is located at the widthwise center of the crease-forming portion 12 is higher than the height H2 of the remaining ribs 14, i.e., the ribs 14 on both sides of the center rib 14 so that the top 14*a* of the center rib 14 protrude outwardly of the circumcircle $C_1$, the corrugated cardboard sheet A is crushed more strongly by the center rib 14, which is higher than the other ribs 14, and becomes thinner, so that a crease L is formed including a deep and clear groove 16 at the center of the groove bottom of the crease L.

Thus, when the corrugated cardboard sheet A is bent along the crease L, the corrugated cardboard sheet A is bent with the groove 16 at the center of the groove bottom of the crease L as a starting point. This makes it possible to bend the sheet A with high accuracy.

In FIGS. 2 to 6, the tops 14*a* of the ribs 14 of the crease-forming portion 12 are in contact, from inside, with the circumcircle $C_1$, which is a circular arc-shaped imaginary curved line and which is a reference line relative to the height positions of the respective tops 14*a*, so that the ribs 14 are within the circumcircle $C_1$. However, the ribs 14 may be arranged so as to be located within a convex, smooth, arc-shaped imaginary curved line which is high at the widthwise center of the crease-forming portion and symmetrical with respect to the widthwise centerline and which is not a true circular arc-shaped imagine curved line, such as an oval line or a parabolic line.

The groove bottoms 15*a* of the grooves 15 may also be in contact, from outside, with an arc-shaped (but not circular arc-shaped) imaginary line as mentioned above, such as an oval or a parabolic line.

The crease-forming portion 12 may be formed such that its surface is formed, as a whole, into a smooth, convex, orderly corrugation by arranging the ribs 14 and the grooves 15 so as to be in contact with the above-described respective arc-shaped (but not circular arc-shaped) imaginary curved lines, and symmetrical with respect to the centerline.

In this case too, only the center rib 14 may protrude outwardly beyond the arcuate imaginary curved line as the reference line relative to the height positions of the tops 14*a* of the ribs 14, and thus beyond the other ribs 14 such that the corrugated cardboard sheet A is crushed more strongly by the center rib 14, which is higher than the other ribs 14, and becomes thinner, so that a crease L is formed including a deep and clear groove 16 at the center of the groove bottom of the crease L.

Figure 8:
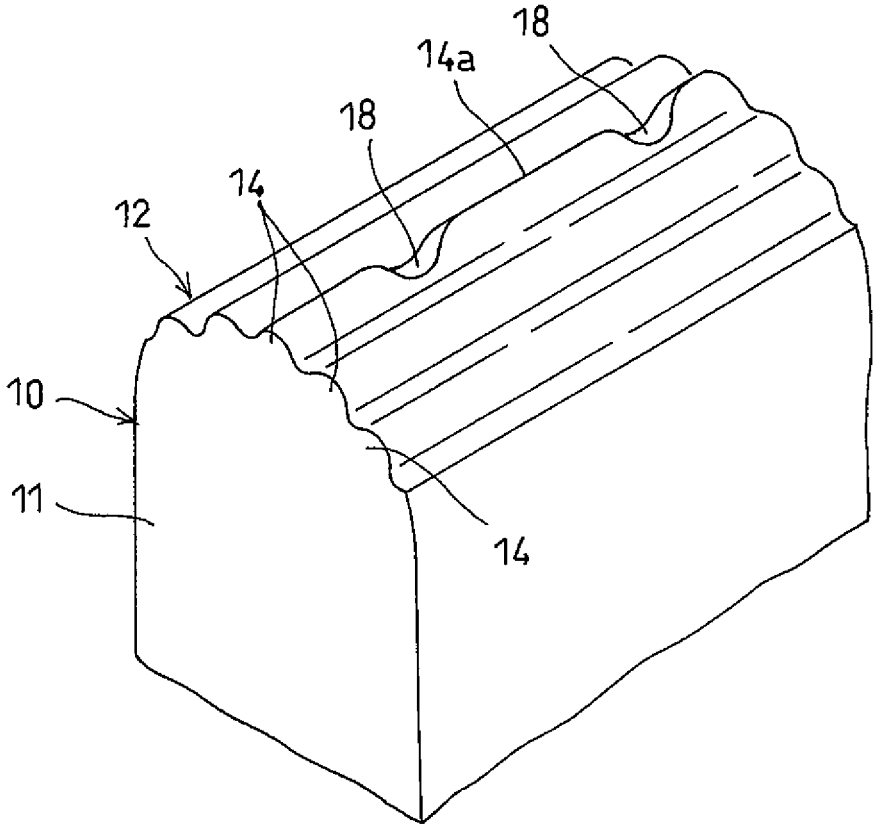
FIG. 8 is a front view of a further different crease-forming member according to the present invention.

While in FIG. 3, the center rib 14 at the widthwise center of the crease-forming portion 12 continuously and linearly extends, as shown in FIG. 8, the center rib 14 may extend linearly while being interrupted by cutouts 18 or grooves as shown in FIG. 8.

Each of the ribs 14 on both sides of the center rib 14 may also extend linearly while being interrupted by cutouts or grooves.

In the above embodiments, the ribs 14 and the grooves 15 of the strip-shaped base plate 11 are radially arranged about the point on the centerline l, but instead, the crease-forming portion 12 may be formed by arranging the ribs 14 and the grooves 15 such that their respective centerlines extend vertically, i.e., parallel to the centerline l and thus both side surfaces of the strip-shaped base plate 11 and so as to be alternately with each other.

In this arrangement, too, as with the above embodiment, the ribs 14 and the grooves 15 may be alternately arranged such that the tops 14*a* of the ribs 14 and the groove bottoms 15*a* of the grooves 15 respectively contact convex, smooth arc-shaped imaginary lines which are symmetrical with respect to the widthwise center of the crease-forming portion 12 and high at the center, such as true circular lines, oval lines or parabolic lines, such that the surface of the crease-forming portions 12 are formed, as a whole, into a smooth, convex, orderly corrugation symmetrical with respect to the centerline so that a crease is formed which has a concave groove bottom formed into, as a whole, a smooth concave corrugation having no corners, complementary in shape to the crease-forming portion 12, and symmetrical with respect to the centerline.

In this case, too, the only the center rib 14 may protrude outwardly beyond the arc-shaped reference line relative to the height positions of the tops 14*a* of the ribs 14 so that a crease L is formed having a deep and clear groove 16 at the center of the groove bottom of the crease L.

In FIGS. 2 to 7, the ribs 14 on the respective sides of the center rib 14 are arranged at equal angular intervals about a point on the centerline l in the width direction of the strip-shaped base plate 11 so as to be arranged symmetrical with respect to the centerline l, but they may be arranged at angular intervals not equal to each other so as to be arranged symmetrical with respect to the centerline l.

Figure 9A:
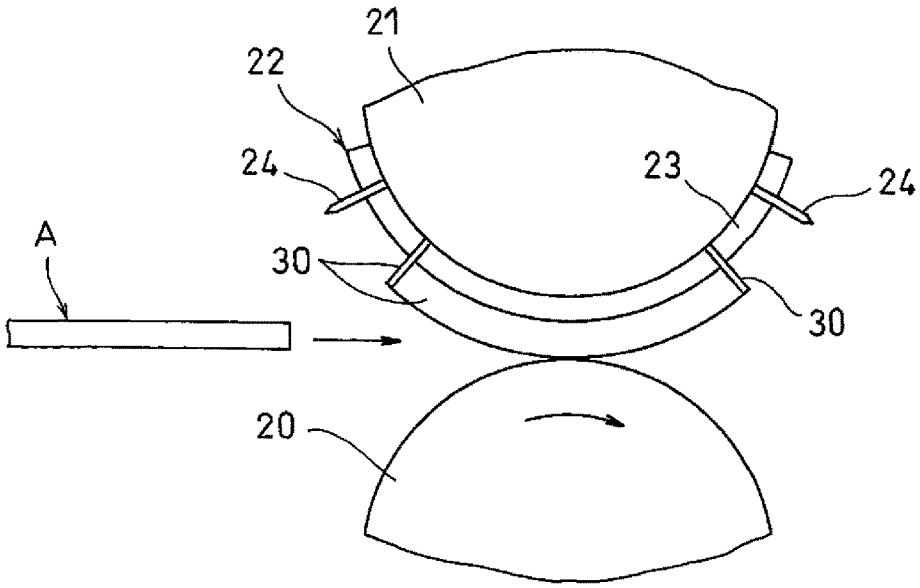
FIG. 9(A) is a vertical sectional view of a different pressed creasing device according to the present invention.
Figure 9B:
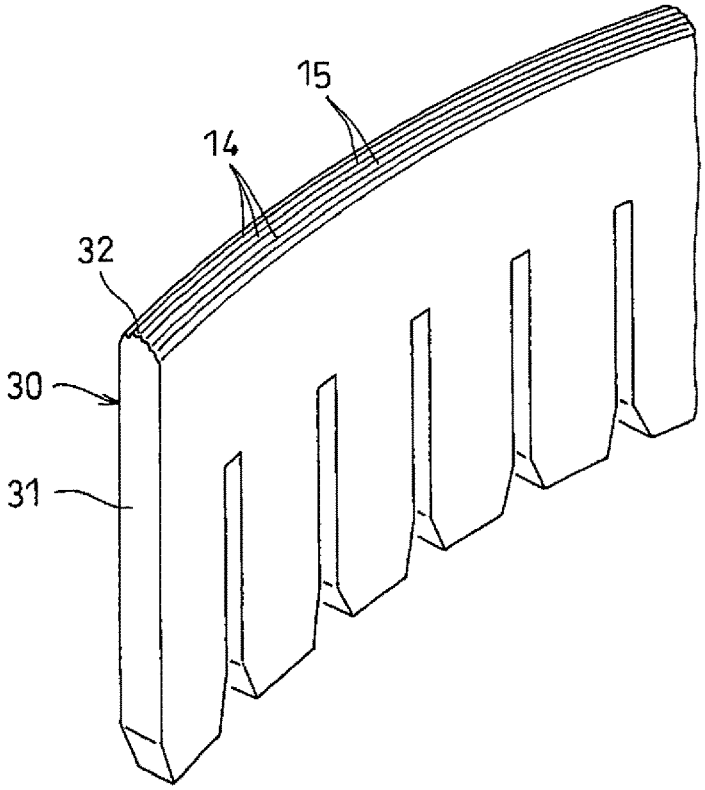
FIG. 9(B) is a perspective view of a portion of a crease-forming member of the creasing device shown in FIG. 9(A).

FIGS. 9A and 9B show a creasing/die-cutting device. This device includes an anvil roll 20 as a support member which has a smooth surface with no protrusions and recesses, and a die roll 21 opposed to the anvil roll 20. A template 22 comprising an arc-shaped board 23 is mounted to the outer periphery of the die roll 21, and die-cutting blades 24 and pressed crease-forming members 30 are mounted to the arc-shaped board 23 so that when a corrugated cardboard sheet A is fed into between the anvil roll 20 and the die roll 21 with the rolls 20 and 21 rotating in opposite directions to each other, the die-cutting blades 24 cut the corrugated cardboard sheet A to a predetermined shape, and simultaneously, the pressed crease-forming members 30 form creases in the corrugated cardboard sheet A.

As shown in FIG. 9B, each pressed crease-forming member 30 for forming a crease extending in the feed direction of the corrugated cardboard sheet A is a strip-shaped base plate 31 comprising an arc-shaped metal strip formed with a crease-forming portion 32 on the peripheral surface at the radially outer end the base plate 31. As with the crease-forming portion 12 shown in FIGS. 3 and 4, the crease-forming portion 32 includes three or a larger-than-three odd number of ribs 14 extending in the circumferential direction, i.e., the longitudinal direction, of the crease-forming portion 32, and concave grooves 15 between the adjacent ribs 14. The ribs 14 and the grooves 15 of the crease-forming portion 32 are identical to those shown in FIGS. 3 and 4. Thus, their description is omitted.

The pressed crease-forming members 30 are capable of forming creases L similar to the crease L shown in FIG. 2 in the corrugated cardboard sheet A, so that the corrugated cardboard sheet A can be bent along the creases L with high accuracy.

As the crease-forming portions 32, ones similar to the crease-forming portion 12 shown in any of FIGS. 5 to 8 may be used instead.

Figure 10A:
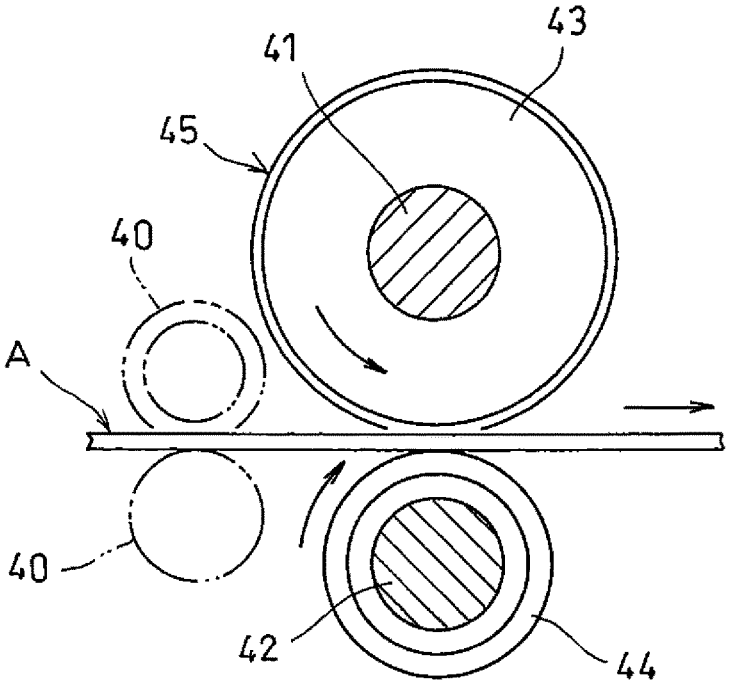
FIG. 10(A) is a vertical sectional view of a still different creasing device according to the present invention.
Figure 10B:
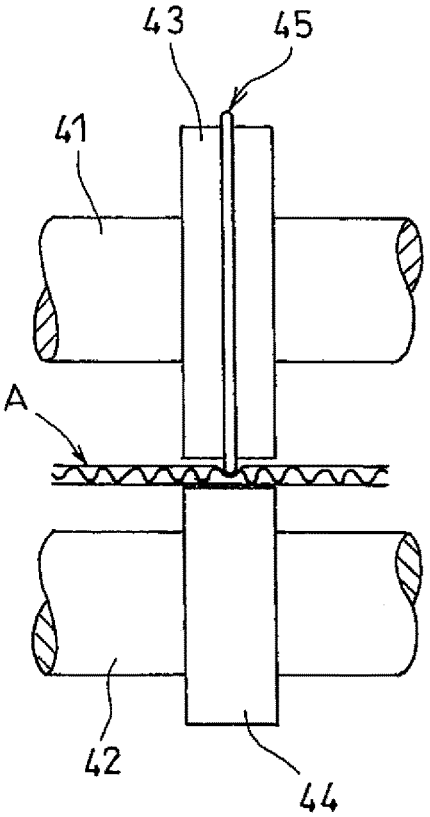
FIG. 10(B) is a side view thereof.
Figure 10C:
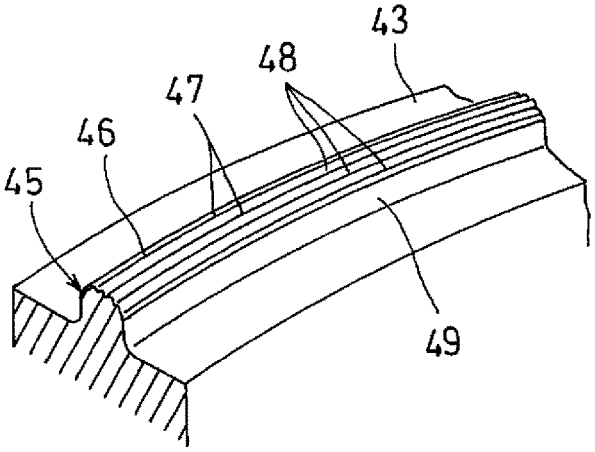
FIG. 10(C) is a perspective view of a portion of a pressed crease-forming roll of the creasing device shown in FIG. 10(A).
Figure 11:
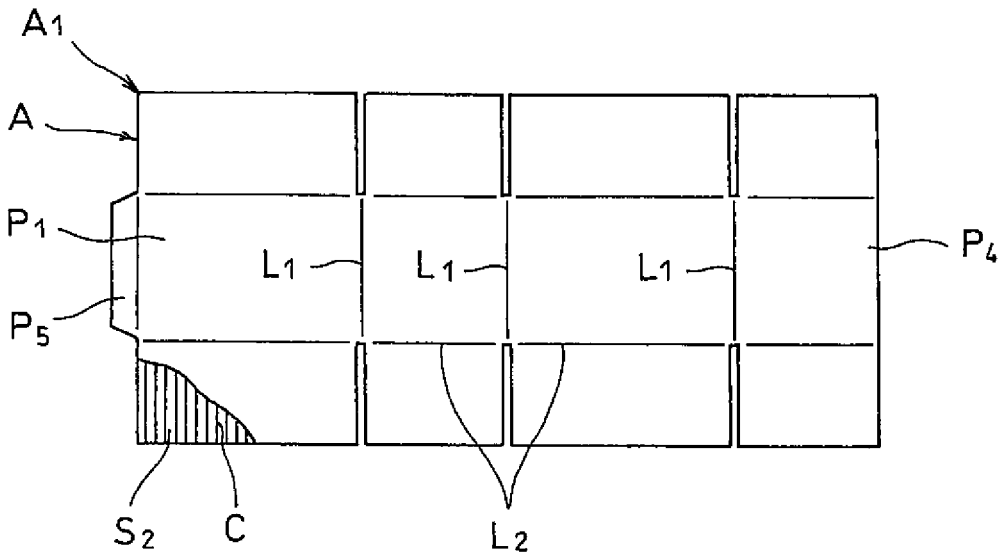
FIG. 11 is a partially cutaway front view of a blank to be formed into a corrugated cardboard box.
Figure 12:
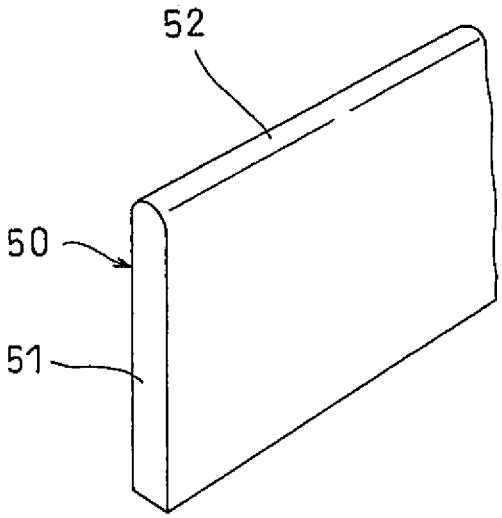
FIG. 12 is a perspective view of a conventional pressed crease-forming member.

FIGS. 10A to 10C show another creasing device. This device includes an upper and lower pair of feed rollers 40 for feeding a corrugated cardboard sheet A in the direction of the arrow, and an upper and lower pair of rotary shafts 41 and 42 provided downstream of the feed rollers 40 and configured to be rotated in opposite directions to each other. A crease-forming roll 43 as a pressed crease-forming member is mounted on the upper rotary shaft 41, while a support roll 44 as a support member having a smooth surface with no protrusions and recesses is mounted on the lower rotary shaft 42.

The crease-forming roll 43 has, on its outer peripheral surface, an annular crease-forming ring 45 comprising a strip-shaped base plate 49 having, at the outer peripheral portion thereof, a crease-forming portion 46 including an odd number of annular ribs 47 arranged so as to be symmetrical with respect to the centerline with one of the annular ribs 47 located at the widthwise center of the crease-forming portion 46.

The odd number of annular ribs 47 have the same sectional shapes as those of the ribs 14 shown in FIG. 4, and circumferential grooves 48 having the same sectional shapes as those of the grooves 15 shown in FIG. 4 are provided between the adjacent annular ribs 47. The odd number of annular ribs 47 are arranged such that the center rib 47 at the widthwise center of the crease-forming ring 45 is the largest in outer diameter, and the farther away each rib 47 on each side of the center rib 47, the smaller its outer diameter is so that the tops of the respective ribs 47 are formed, as a whole, into a convex shape.

When the center rib 14 protrudes beyond the other ribs 14, instead of arranging the tops 14*a* of the ribs 14 on both sides of the center rib 14 such that the farther away these tops 14*a* are from the top 14*a* of the center rib 14, and thus the closer to the respective sides of the crease-forming portion 46, the smaller their outer diameters are, some of these tops 14*a* may be of the same outer diameter. As the crease-forming portion, one similar to the crease-forming portion 12 shown in any of FIGS. 5 to 8 may be used instead.

With this crease-forming device, when the corrugated cardboard sheet A is fed into between the crease-forming roll 43 and the support roll 44 by the pair of feed rollers 40 with the rolls 43 and 44 rotating in the directions shown by the arrows in FIG. 10A, the crease-forming portion 46 on the outer periphery of the annular crease-forming ring 45 of the crease-forming roll 43 presses one side of the corrugated cardboard sheet A, thereby forming a crease L, similar to the crease L shown in FIG. 2, of which the groove bottom is formed into a smooth corrugation having no corners, whereby the groove bottom of the crease L is formed, as a whole, into a smooth concave shape complementary in shape to the crease-forming portion 46. Thus, the corrugated cardboard sheet A can be bent along the crease L with high accuracy.

In either of the embodiment of FIGS. 9A and 9B and the embodiment of FIGS. 10A-10C too, any of the following arrangements may be used:

(1) The tops of all of the ribs are in contact, from inside, with a convex, smooth, arc-shaped imaginary curved line which is symmetrical with respect to the centerline and high at the center, as a reference line relative to the tops of the ribs, while the groove bottoms of the grooves of the crease-forming portion are in contact, from outside, with a convex, smooth, arc-shaped imaginary curved line which is symmetrical with respect to the centerline and high at the center.

(2) Only the tops of the center rib protrude beyond the tops of the other ribs.

(3) The tops of all of the ribs other than the center rib are in contact, from inside, with a convex, smooth, arc-shaped imaginary curved line which is symmetrical with respect to the centerline and high at the center, as a reference line relative to the height positions of the respective tops.

(4) All of the ribs are radially arranged about a point on the widthwise centerline which extends along the widthwise center of the strip-shaped base plate in parallel to both side surfaces of the strip-shaped base plate.

(5) All of the ribs are arranged such that their center lines extend vertically in parallel to the side surfaces of the strip-shaped base plate.

(6) Each of the ribs and the grooves has smooth, cornerless inclined side surfaces which are inclined in opposite directions to each other such that the ribs and the grooves are tapered, or as an alternative, the side surfaces extend vertically.

(7) The annular ribs on both sides of the annular center rib are arranged such that the farther away their tops are from the center rib and thus the closer to the respective sides of the crease-forming portion, the smaller their diameters are.

In the embodiments, creases are formed in corrugated cardboard sheets A, but the creasing devices of the present invention may be used to form creases not only in corrugated cardboard sheets A but in other sheet members such as non-corrugated cardboard sheets.

DESCRIPTION OF THE NUMERALS

A. Corrugated cardboard sheet
1. Support plate
2. Template
3. Board
10, 30. Pressed crease-forming member
11, 31, 49. Strip-shaped base plate
12, 32, 46. Crease-forming portion
14. Rib
14*a*. top
14*b*. Side surface
15. Groove
15*a*. Groove bottom
20. Anvil roll
21. Die roll
22. Template
23. Arc-shaped board
43. Crease-forming roll
44. Support roll
45. Crease-forming ring
47. Annular rib
48. Circumferential groove

What is claimed is:

1. A pressed crease-forming member comprising a strip-shaped base plate made from metal and having a wall thickness of 7.0 mm or less, the strip-shaped base plate including a crease-forming portion at one end of the strip-shaped base plate, the crease-forming portion being configured to be capable of forming a crease in a corrugated cardboard sheet along which the corrugated cardboard sheet can be bent, by pressing the crease-forming portion into the corrugated cardboard sheet, wherein:

the crease-forming portion has a surface on which are formed five or a larger-than-five odd number of narrow ribs substantially equal in width to each other, and extending in a longitudinal direction of the crease-forming portion, the ribs comprising a center rib located at a widthwise center of the crease-forming portion, and the remaining even number of ribs, each half of the remaining even number of ribs being arranged on each side of the center rib;

the ribs have tops, of which the top of the center rib is chamfered, and the top of each of the remaining even number of ribs is a curved surface;

each of the ribs is formed into a protruding shape by two side surfaces inclined in opposite directions to each other and extending toward the top such that the rib has a substantially V-shaped cross section tapered toward the top, the side surfaces of each of the remaining even number of ribs being smoothly connected to the curved surface of the top of a corresponding one of the remaining even number of ribs;

grooves are formed, each of the grooves being formed between an adjacent pair of the ribs by an opposed pair of the side surfaces of the ribs such that, when the crease-forming portion is pressed into the corrugated cardboard sheet, the corrugated cardboard sheet is bent so as to extend along the opposed pairs of the side surfaces;

the top of each of the ribs is formed into a convex shape;

each of the grooves has a bottom and is recessed from the tops of the ribs on both sides of the groove;

the ribs and the grooves are arranged alternately with each other such that the crease-forming portion has, as a whole, a smooth and orderly corrugated shape having no corners;

the odd number of ribs extend along lines extending in radial directions from an origin point on a widthwise centerline extending parallel to side surfaces of the strip-shaped base plate so as to be symmetric with respect to the widthwise centerline; and a common circumferential arc can be formed using the origin point as center and contacting a point of each of the remaining even number of ribs that is most distant from the origin point.

2. The pressed crease-forming member of claim 1, wherein the center rib protrudes outwardly beyond the common circumferential arc.

3. A pressed crease-forming member comprising a crease-forming roll of a creasing device, the creasing device comprising a support roll and the crease-forming roll which are configured to be rotated in opposite directions to each other, wherein the crease-forming roll includes a crease-forming portion including, on an outer periphery of the crease-forming portion, an annular crease-forming ring, the creasing device being configured such that the annular crease-forming ring forms a groove-shaped crease in a corrugated cardboard sheet along which the corrugated cardboard sheet can be bent, when the corrugated cardboard sheet is fed into between the support roll and the crease-forming roll, wherein:

the annular crease-forming ring has an outer peripheral surface on which are formed five or a larger-than-five odd number of annular ribs extending in a circumferential direction of the annular crease-forming ring, the annular ribs comprising an annular center rib located at a widthwise center of the crease-forming portion, and the remaining even number of annular ribs, each half of the remaining even number of annular ribs being arranged on each side of the annular center rib;

the annular ribs have tops, of which the top of the annular center rib is chamfered, and the top of each of the remaining even number of annular ribs is a curved surface;

each of the annular ribs is formed into a protruding shape by two side surfaces inclined in opposite directions to each other and extending toward the top such that the annular rib has a substantially V-shaped cross section tapered toward the top, the side surfaces of each of the remaining even number of annular ribs being smoothly connected to the curved surface of the top of a corresponding one of the remaining even number of annular ribs;

circumferential grooves are formed, each of the circumferential grooves being formed between an adjacent pair of the annular ribs by an opposed pair of the side surfaces of the annular ribs such that, when the crease-forming portion is pressed into the corrugated cardboard sheet, the corrugated cardboard sheet is bent so as to extend along the opposed pairs of the side surfaces;

each of the circumferential grooves has a bottom and is formed into a recessed shape by each pair of the side surfaces of the circumferential grooves such that the bottom is recessed radially inwardly of the annular crease-forming ring beyond the tops of the annular ribs on both sides of the circumferential groove;

the top of each of the annular ribs is formed into a convex shape;

the annular ribs and the circumferential grooves are arranged alternately with each other such that the crease-forming portion has, as a whole, a smooth and orderly corrugated shape having no corners;

the odd number of annular ribs extend along lines extending in radial directions from an origin point on a widthwise centerline extending parallel to side surfaces of the crease-forming roll so as to be symmetric with respect to the widthwise centerline; and a common circumferential arc can be formed using the origin point as center and contacting a point of each of the remaining even number of annular ribs that is most distant from the origin point.

4. The pressed crease-forming member of claim 3, wherein the annular center rib protrudes outwardly beyond the common circumferential arc.

* * * * *